United States Patent [19]

Yamanaka et al.

[11] 3,982,971

[45] Sept. 28, 1976

[54] RARE EARTH-CONTAINING PERMANENT MAGNETS

[75] Inventors: Yoshio Yamanaka; Kazuyoshi Watanabe; Masakatsu Honshima; Hideaki Kikuchi, all of Takefu, Japan

[73] Assignee: Shin-Etsu Chemical Co., Ltd, Tokyo, Japan

[22] Filed: Feb. 20, 1975

[21] Appl. No.: 551,157

[30] Foreign Application Priority Data

Feb. 21, 1974 Japan ..... 49-20720
Feb. 25, 1974 Japan ..... 49-22139

[52] U.S. Cl. ..... 148/31.57; 148/101; 148/103; 148/105; 148/102; 75/152

[51] Int. Cl.[2] ..... H01F 1/04

[58] Field of Search ..... 148/103, 102, 101, 31.57, 148/105; 75/84, 152

[56] References Cited

UNITED STATES PATENTS

| | | | |
|---|---|---|---|
| 3,424,578 | 1/1969 | Strnat et al. | 148/103 |
| 3,684,593 | 8/1972 | Benz et al. | 148/31.57 |
| 3,755,007 | 8/1973 | Benz et al. | 148/101 |

OTHER PUBLICATIONS

Nesbitt, E.; New Perm. Mag. Mtls. Containing Rare--Metals, in J. Appl. Phys., 40, Mar. 1969 pp. 1259–1265.

*Primary Examiner*—Walter R. Satterfield
*Attorney, Agent, or Firm*—Toren, McGeady and Stanger

[57] ABSTRACT

Permanent magnets are disclosed having a very high coercive force and a very great maximum energy product, and consisting essentially of a rare earth-cobalt based alloy. The alloy is expressed by the formula $Sm_{1-u}Ce_u(Co_{1-v-w-x}Cu_vFe_wMn_x)_z$ where $0 \leqq u \leqq 0.20$, $0.08 \leqq v \leqq 0.20$, $0 \leqq w \leqq 0.08$, $0.01 \leqq x \leqq 0.15$ and $6.0 \leqq z \leqq 7.8$, preferably $7.2 \leqq z \leqq 7.8$. By using these alloys, the magnetic properties of the resultant permanent magnets are superiorly affected, and the magnet-preparing process is rendered much simplified. This is also because the conventional heat aging step may be eliminated, particularly when the z value is within the preferred range.

5 Claims, No Drawings

RARE EARTH-CONTAINING PERMANENT MAGNETS

FIELD OF THE INVENTION

This invention relates to a novel and improved alloy suitable for the preparation of permanent magnets and, in particular, to an alloy based on rare earth metals and cobalt which is capable of giving permanent magnets having a very high coercive force and a very large maximum energy product. The invention also relates to a very much simplified process for the preparation of such permanent magnets, using the alloy.

DESCRIPTION OF THE PRIOR ART

It has been established that a rare earth-containing alloy with the composition expressed by the formula $RM_z$, where R is a rare earth element of either samarium, cerium, or a combination thereof with, optionally, several other rare earth elements, M is cobalt partially substituted, optionally, by iron and copper and z is a positive number between 5.0 and 8.5, is one of the most promising permanent magnet alloys, and extensive investigational efforts have been directed toward an optimum blend of the individual alloying components to give the most superior properties to the permanent magnets prepared therefrom.

According to the prior art, it has been difficult to satisfy the requirements for magnetic properties of the permanent magnets in terms of, among others, residual magnetization $B_r$, coercive force ${}_IH_c$ and maximum energy product $(BH)_{max}$, all at once. For instance, in a permanent magnet prepared from the alloy having a composition expressed by the formula $Sm_{0.3}Ce_{0.7}(Co_{0.8-6}Fe_{0.05}Cu_{0.09})_z$ where z is a value variable between 5.0 and 8.5, the values of ${}_IH_c$ and $(BH)_{max}$ are at the maximum when z is 6.5, and rapidly drop as the z value increases (see Japanese Journal of Applied Physics, vol. 12, page 761, 1973). In this connection, it should be noted that the maximum of the value of the coercive force or the maximum energy product is not larger than, say, 3,000 oersted or 14 megagauss-oersted, respectively. These values are not satisfactory since they are far from the expected theoretical values. Therefore, it has been impossible to use any greater value for z in the rare earth-cobalt based alloys without bringing about decreases in the coercive force and the maximum energy product, though it was meant that a greater z value would lessen the use of rare earth metals which are more expensive than such metals as copper, iron and cobalt.

OBJECT OF THE INVENTION

The primary object of the present invention is to provide a permanent magnet alloy having superior properties, free of the above-described defects and, specifically, solve the problem between the z value and the coercive force and the maximum energy product.

Another object of the invention is to provide a much simplified process for the preparation of permanent magnets omitting the conventional aging step.

DETAILED DESCRIPTION OF THE INVENTION

The permanent magnet alloy of the present invention has the composition expressed by the formula $$Sm_{1-u}Ce_u(Co_{1-v-w-x}Cu_vFe_wMn_x)_z$$

where $0 \leqq u \leqq 0.20$, $0.08 \leqq v \leqq 0.20$, $0 \leqq w \leqq 0.08$, $0.01 \leqq x \leqq 0.15$ and $6.0 \leqq z \leqq 7.8$. The z value in this formula according to the invention can advantageously be much greater than in the prior art case, so that lesser amount of the more expensive rare earth metal can be used. This permanent magnet alloy of the invention may be used in the manufacture of rare earth-cobalt based permanent magnets by a conventional process which comprises the steps of providing by weighing, the individual metals in appropriate amounts, melting them together to produce an alloy, pulverizing the alloy into fine powder by any suitable means, shaping the thus obtained powder by compression molding in a magnetic field into a block of a desired form, then subjecting the block to sintering at a temperature between 1,000° and 1,300°C, preferably between 1,170° and 1,270°C, and subsequently to aging at a temperature between 800° and 900°C, with subsequent cooling to room temperature to finally obtain the products.

According to the above conventional process, the heat aging step is considered to be an indispensable one. The inventors, therefore, studied the possibilities of simplifying the process by eliminating the aging step, and have discovered surprisingly that the alloy of the invention having the composition in which the z value is in the range of from 7.2 to 7.8 imparts the most desirable properties to the resultant permanent magnets even without the performance of the aging step.

In processing the permanent magnet alloys of the invention having the composition in which the z value is in the range of from 7.2 to 7.8, the cooling velocity after completion of the sintering must be as high as possible. It is noteworthy that the higher the cooling velocity is, the more perfect will be the squareness of the hysteresis loops of the resultant magnets. However, when the cooling velocity is too high, it tends to cause cracking in the sintered blocks and, furthermore, it is practically very difficult to have all of the sintered blocks cooled down at a uniform velocity within the sintering furnace, so that the quality of the resultant magnets will be irregular in a wider range. Therefore, the cooling velocity should be chosen to range from 1°C/second to 30°C/second, preferably from 5°C/second to 30°C/second. The cooling velocity in the above range must be maintained at least until the temperature of the sintered blocks under cooling reaches 800°, preferably 700°C.

According to the most preferred embodiment of the invention, the rare earth metal present in the alloy is substantially pure samarium, although other rare earth metals, especially cerium, may be incorporated in small amounts, variable naturally depending on their kind. In particular, when cerium is incorporated together with samarium in an amount not exceeding 20 atomic % of the total amount of cerium and samarium, the resultant permanent magnets will have the magnetic properties of practically the same level as in the case where pure samarium is present alone.

Further, in respect of the alloying components other than the rare earth metals, in the composition of the permanent magnet alloys according to the invention, the incorporation of iron is not always required, although decrease in its amount tends to cause the residual magnetization $B_r$ to go down, while increase in its amount over the above-defined range will bring about such disadvantages that the coercive force ${}_IH_c$ is lowered and the squareness of the hysteresis loops becomes less perfect. Similarly, increase in the amount of copper tends to lower $B_r$ and the use of copper in an amount exceeding the above-defined range will cause the lowering of ${}_iH_c$. Further, the addition of manganese in an amount within the above-defined range has an effect to remarkably improve the maximum energy product — $(BH)_{max}$. The maximum energy product is decreased by addition of manganese in an amount exceeding the above-defined range. The residual magnetization $B_r$ is, however, hardly affected by addition of manganese insofar as its amount is within or less than the defined range. As seen from the above, contradictory effects are exhibited in some cases by varied proportions of amounts of different metals incorporated in the alloys. It is therefore necessary that care should be taken in blending the individual alloying metals in consideration of the desired characteristics of the finished magnet products, although high-performance permanent magnets with no noticeable defects in the practical meaning can be obtained from the alloys of the composition within the defined range.

The following examples are given to further illustrate the invention but not to limit the scope of the invention.

EXAMPLE 1.

Five permanent magnets, A, B, C, D and E, with the alloy compositions expressed by the formula $$Sm_{1-u}Ce_u(Co_{1-v-w-x}Cu_vFe_wMn_x)_z$$

where the values of u, v, w, x and z were as shown in the following table were prepared by melting together weighed amounts of the individual metals in an induction furnace to form alloys, pulverizing the alloys by a jet mill into fine powder with the average particle diameter of about 2 to 5$\mu$m as measured by the air-permeation method, shaping the powders by the compression molding in a magnetic field of 15,000 oersted to form blocks, subjecting the blocks to sintering at a temperature from 1,220° to 1,230°C for about 1 hour, and cooling the thus sintered blocks at a velocity of about 6°C/second to a temperature between 800° and 820°C, where the blocks were subjected to aging for about 30 minutes. The thus obtained permanent magnets exhibited magnetic properties as set out in the table.

EXAMPLE 2.

Five permanent magnets F, G, H, I and J, with the alloy compositions as set out in the same table were prepared by molding the corresponding alloy powders into blocks by the compression molding in a magnetic field of about 10,000 oersted, subjecting the blocks to sintering at a temperature from 1,215° to 1,250°C for about 1 hour, and cooling the thus sintered blocks at a velocity of 12°/second to 700°C, followed immediately by further cooling to room temperature. The magnetic properties of the thus obtained permanent magnets are given in the table.

The permanent magnets F and J are shown as control examples in relation to the z value. They have rather poor magnetic properties especially in the coercive force.

Table

| Example | Sample | u | v | w | x | z | $B_r$ (gauss) | ${}_iH_c$ (oersted) | $(BH)_{max}$ (megagauss-oersted) |
|---|---|---|---|---|---|---|---|---|---|
| | A | 0 | 0.15 | 0.05 | 0.03 | 7.0 | 8,900 | 8,500 | 19.0 |
| | B | 0 | 0.15 | 0.05 | 0.03 | 6.2 | 8,200 | 7,300 | 16.5 |
| 1 | C | 0 | 0.18 | 0 | 0.06 | 7.0 | 9,000 | 8,300 | 20.2 |
| | D | 0.08 | 0.18 | 0 | 0.06 | 7.0 | 8,800 | 8,300 | 19.2 |
| | E | 0.20 | 0.18 | 0 | 0.06 | 7.0 | 8,500 | 7,800 | 16.0 |
| | F | 0 | 0.15 | 0.05 | 0.05 | 7.0 | 8,700 | 600 | Not determined |
| | G | 0 | 0.15 | 0.05 | 0.05 | 7.25 | 9,000 | 4,100 | 9.0 |
| 2 | H | 0 | 0.15 | 0.05 | 0.05 | 7.5 | 9,300 | 8,900 | 19.2 |
| | I | 0 | 0.15 | 0.05 | 0.05 | 7.8 | 9,300 | 4,800 | 8.0 |
| | J | 0 | 0.15 | 0.05 | 0.05 | 8.0 | 8,500 | 1,200 | Not determined |

What is claimed is:

1. A process for the preparation of a permanent magnet which comprises the steps of shaping the powder of an alloy expressed by the formula $Sm_{1-u}Ce_u(Co_{1-v-w-x}Cu_vFe_wMn_x)_z$ where $0 \leqq u \leqq 0.20$, $0.08 \leqq v \leqq 0.20$, $0 \leqq w \leqq 0.08$, $0.01 \leqq x \leqq 0.15$, and $7.2 \leqq z \leqq 7.8$, into a block by compression molding in a magnetic field, subjecting said block to sintering at a temperature in the range of from 1,170° to 1,270°C, and cooling the thus sintered block at a cooling velocity between 1°C/second and 30°C/second to a temperature of about 800°C, with subsequent cooling to room temperature without any intermediate aging step.

2. A process for the preparation of a permanent magnet which comprises the steps of shaping the powder of an alloy expressed by the formula $Sm_{1-u}Ce_u(Co_{1-v-w-x}Cu_vFe_wMn_x)_z$ where $0 \leqq u \leqq 0.20$, $0.08 \leqq v \leqq 0.20$, $0 \leqq w \leqq 0.08$, $0.01 \leqq x \leqq 0.15$, and $7.2 \leqq z \leqq 7.8$, into a block by compression molding in a magnetic field, subjecting said block to sintering at a temperature in the range of from 1,170° to 1,270°C, and cooling the thus sintered block at a cooling velocity between 1°C/second and 30°C/second to a temperature of about 800°C, aging the thus cooled block at this temperature and thereafter cooling the aged block to room temperature.

3. A permanent magnet prepared by the process of claim 1.

4. A permanent magnet prepared by the process of claim 2.

5. The process as claimed in claim 1, wherein said cooling velocity is from 5° per second to 30°C per second.

* * * * *